US005526780A

United States Patent [19]

Wallis

[11] Patent Number: 5,526,780

[45] Date of Patent: Jun. 18, 1996

[54] GAS SEALING SYSTEM FOR ROTARY VALVES

[75] Inventor: Anthony B. Wallis, Gladesville, Australia

[73] Assignee: A. E. Bishop Research Pty. Limited, North Ryde, Australia

[21] Appl. No.: 424,436

[22] Filed: May 3, 1995

[30] Foreign Application Priority Data

Nov. 6, 1992 [AU] Australia ..... PL5728

[51] Int. Cl.[6] ..... F01L 7/00

[52] U.S. Cl. ..... 123/190.6; 123/190.8; 123/190.17

[58] Field of Search ..... 123/190.4, 190.6, 123/190.8, 190.16, 190.17, 190.1

[56] References Cited

U.S. PATENT DOCUMENTS

| | | | |
|---|---|---|---|
| 2,211,288 | 8/1940 | Oesch | 123/190.8 |
| 4,019,487 | 4/1977 | Guenther | 123/190.2 |
| 4,467,751 | 8/1984 | Asaka et al. | 123/190.17 |
| 4,852,532 | 8/1989 | Bishop | 123/190.8 |
| 5,152,259 | 10/1992 | Bell | 123/190.2 |
| 5,154,147 | 10/1992 | Muroki | 123/190.8 |

FOREIGN PATENT DOCUMENTS

| | | | |
|---|---|---|---|
| 2234300 | 1/1991 | United Kingdom | 123/190.17 |

*Primary Examiner*—David A. Okonsky
*Attorney, Agent, or Firm*—Nikaido, Marmelstein, Murray & Oram

[57] ABSTRACT

A rotary valve assembly for an internal combustion engine characterized in that the valve has a combination of axial sealing elements (21,22) and inner circumferential sealing elements (23,24) arranged to form a first seal pressurizing cavity extending circumferentially between the axial sealing elements (21,22) and two second seal pressurizing cavities each lying between the inner (23,24) and adjacent outer (25,26) circumferential sealing elements axially on each side of a window opening in a cylinder head (16) in which the valve rotates, the arrangement being such as to permit high pressure combustion gas to pass from the first cavity to the two second cavities whereby curing combustion the outer circumferential sealing elements (25,26) are caused to seal the second pressurizing cavities by being forced against the axially outermost sides of circumferentially extending grooves (36,37) in which they are located to prevent axially outward movement of gas, and the inner circumferential sealing elements (23,24) are caused to be loaded axially inwardly to seal against axially innermost sides of circumferentially extending grooves (34,35) in which they are located and to load the four circumferential sealing elements (23,24,25,26) radially to seal against a bore surface (19) in which the valve is housed and against which they are preloaded.

11 Claims, 14 Drawing Sheets

GAS SEALING SYSTEM FOR ROTARY VALVES

The present invention relates to a gas sealing system for sealing a rotary valve assembly used in an internal combustion engine. The sealing means of the present invention may be utilised on any cylindrical rotary valve which has one or more openings in the valve periphery which periodically aligns with a similar shaped window in the combustion chamber to allow passage of gas from the valve to the combustion chamber or vice versa. During a portion of the cycle when compression and combustion of gases takes place, the periphery of the valve blocks the window in the combustion chamber. The sealing system prevents the escape of high pressure gases from the combustion chamber during this portion of the cycle.

Specific examples of such valves are outlined below but the invention is by no means restricted to these examples.

1. Axial flow rotary valve for use in 4 stroke cycle where both inlet and exhaust ports are combined in the same valve.

2. Radial flow rotary valve for four stroke cycle where both inlet and exhaust ports are combined into the same valve or alternatively are accommodated in separate valves.

3. Axial or radial flow rotary valve for use on 2 stroke engines where the exhaust and/or inlet port is accommodated in valve.

A gas sealing system according to the invention is applicable to cylindrical rotary valves which accommodate one or more ports in the valve terminating as openings in the valve periphery. During rotation of the valve each opening in the periphery of the valve periodically aligns with a similar window in the cylinder head, the latter which opens directly into the combustion chamber. The valve is supported by bearings located adjacent a central cylindrical portion in which the opening(s) in the valve's periphery is (or are) located. The valve and its bearings are located in a bore in the cylinder head in such a fashion as to ensure the central cylindrical zone can rotate while always maintaining a small radial clearance to the bore.

Large numbers of rotary valves have been proposed and constructed in the past without commercial success. One of the major contributions to this lack of commercialisation is the failure to arrive at a satisfactory gas sealing system.

The present invention is particularly concerned with a sealing system utilising a "window of floating seals". In this system the valve rotates with a small radial clearance to the cylinder head bore and a system of four or more separate sealing elements form a floating seal grid around the periphery of an approximately rectangular window. Various examples of this are to be found in the prior art including Dana Corporation U.S. Pat. No. 4,019,487 and Bishop U.S. Pat. No. 4,852,532 of which the latter is the most relevant. The systems disclosed in the specifications of the abovementioned patents have the major advantage that the window length (and therefore rate of valve opening) is not limited by the sealing system. Window lengths of greater than 85% of piston bore diameter are possible. In addition the Bishop sealing system can be designed so that it contributes no penalty in the radial depth between the rotary valve and the cylinder head face or top of cylinder bore. Combustion chamber shapes are thus much improved, together with the capability of reducing combustion chamber volume sufficiently to obtain high compression ratios.

Valves incorporating both inlet and exhaust ports in the same valve must be able to prevent any significant flow between the ports. In the Bishop specification which incorporated inlet and exhaust ports in the same valve, a method of sealing is described that relies on the maintaining of a very small clearance between the cylinder head bore and that portion of the valve periphery that extends between the inlet and exhaust port openings. This method, while not forming a total seal between the ports, is adequate because:

1. Pressure difference between ports is small;

2. The radial gap through which gases can flow is very small and flow is quickly choked;

3. The ports contain such a large volume that the tiny flow between the ports produces negligible effect on the port pressure.

Although this system may suffer from problems on a carburettor type system where small amounts of unburned fuel may be passed into the exhaust port and therefore produce unwanted hydrocarbon emissions, modern timed, electronically controlled fuel injection systems will exhibit no such problem.

The present invention relates to a sealing system of the above type, ie. windows of floating seals together with the Bishop solution to sealing between ports.

Bishop U.S. Pat. No. 4,852,532 describes a system of seals consisting of two axially extending seals located either side, of the cylinder head combustion chamber window and loaded against the periphery of the valve, abutted at either end by a circumferentially extending ring seal, the inner diameter of which rubs sealingly against the valve's periphery.

The function of these seals is to trap the high pressure combustion gases within the rectangle formed by the inner surface of these seals. The effectiveness of this sealing system depends on its ability to seal the zone at the point of intersection of the individual sealing elements. As the abutting seals must be free to move independently of each other (to accommodate thermal expansion and manufacturing tolerances) there will always be a small gap at each intersection point. As there are four such intersection points per assembly the total leakage gap has the potential to be very large. The total of these leakage areas of the valve assembly will be referred to as the "total effective leakage area" or "TELA".

To appreciate the significance of the TELA it is instructive to consider the leakage area of a piston seal assembly. Unlike the rotary valve sealing system a piston ring seal has only one gap through which leakage can occur. The leakage area of this gap is given by the product of the piston ring gap and the radial clearance of the piston crown to the piston bore. Typically the piston ring gap and the radial clearance of the piston crown to the piston bore are both 0.25 mm giving a leakage area of 0.0625 $mm^2$.

In a conventional automobile popper valve assembly, popper valves have zero gaps (and hence zero TELA) so that total combustion chamber leakage area is typically 0.0625 $mm^2$. With a rotary valve the TELA of the rotary valve's sealing system must be added to the leakage area of the piston seals to give the total leakage area of the combustion chamber. It has been shown in studies on piston rings that the rate of leakage past a piston ring is directly proportional to the leakage area of the piston ring itself. Therefore, in order for a rotary valve sealing system of the type described to be feasible, the TELA of the four intersection points at the corners of the "window of floating seals" must be a small fraction of the leakage area of the piston ring.

In the sealing system proposed in the Bishop U.S. Pat. No. 4,852,532, the high pressure compression and combustion gases load the ring seals axially outwardly against the side faces of the circumferential grooves within the cylinder head bore, thus opening up the gap between the ends of the axial seals and the adjacent ring seals. The TELA of this gap is given by the product of the axial clearance between the end of the axial seal and the side face of the adjacent ring seal, and the depth of the circumferential groove plus the product of the ring seal's radial clearance to the bottom of the circumferential groove and the width of the groove. It can be shown, on the basis of reasonable assumptions as to these sizes, that the TELA is of the order of twenty times the leakage area of a piston ring assembly.

The present invention consists in a rotary valve assembly for an internal combustion engine comprising a hollow cylindrical valve, said valve having one or more ports terminating as openings in its periphery, a cylinder head having a bore in which said valve rotates in a predetermined small clearance fit, a window in said cylinder head bore communicating with a combustion chamber, said openings successively aligning with said window by virtue of said rotation, bearing means at least one axially each side of the window for journalling said valve in said cylinder head bore, said bearing means serving to maintain said predetermined small clearance fit, axial sealing elements housed within said cylinder head bore extending inwardly of said bore an amount equal to said predetermined clearance fit and being preloaded against the periphery of the valve, said axial sealing elements being housed within axially extending grooves formed in said cylinder head bore, said grooves being positioned at least one on each side circumferentially of said window, two inner circumferential sealing elements positioned along the axis of said valve and housed in circumferentially extending grooves formed either in said periphery of said valve or in said cylinder head bore and radially preloaded against the surface of the other, each said inner circumferential sealing element being positioned at either axial extremity of said axial sealing elements and immediately adjacent thereto, a first seal pressurising cavity existing by virtue of said predetermined small clearance fit and formed circumferentially between said axial sealing elements either side of said window, and bounded axially by the planes of the inner faces of said inner circumferential sealing elements, whereby high pressure combustion gas pressurises said first seal pressurising cavity during combustion by virtue of said communication between said window and said combustion chamber thereby loading said axial sealing elements radially inwardly against said periphery of said valve in a direction so as to augment said preload, and circumferentially outwardly against the sides of said axially extending grooves, characterised in that, at least two outer circumferential sealing elements are also positioned along the axis of said valve, at least one axially outwardly of each said inner circumferential sealing element, thereby defining two second seal pressurising cavities, each lying between adjacent inner and outer circumferential sealing elements, axially on either side of said window, and passage means permitting said high pressure combustion gas to pass from said first seal pressurising cavity to said two second seal pressurising cavities, whereby, during combustion, said outer circumferential sealing elements are caused to seal said second seal pressurising cavities to prevent axially outward movement of gas and said inner circumferential sealing elements are caused to be loaded axially inwardly to seal against the axially innermost sides of said circumferentially extending grooves, and loaded radially to seal against the surface against which they are preloaded.

In order that the invention may be better understood and put into practice a preferred embodiment thereof is hereinafter described by way of example with reference to the accompanying drawings in which.

Figure 3:
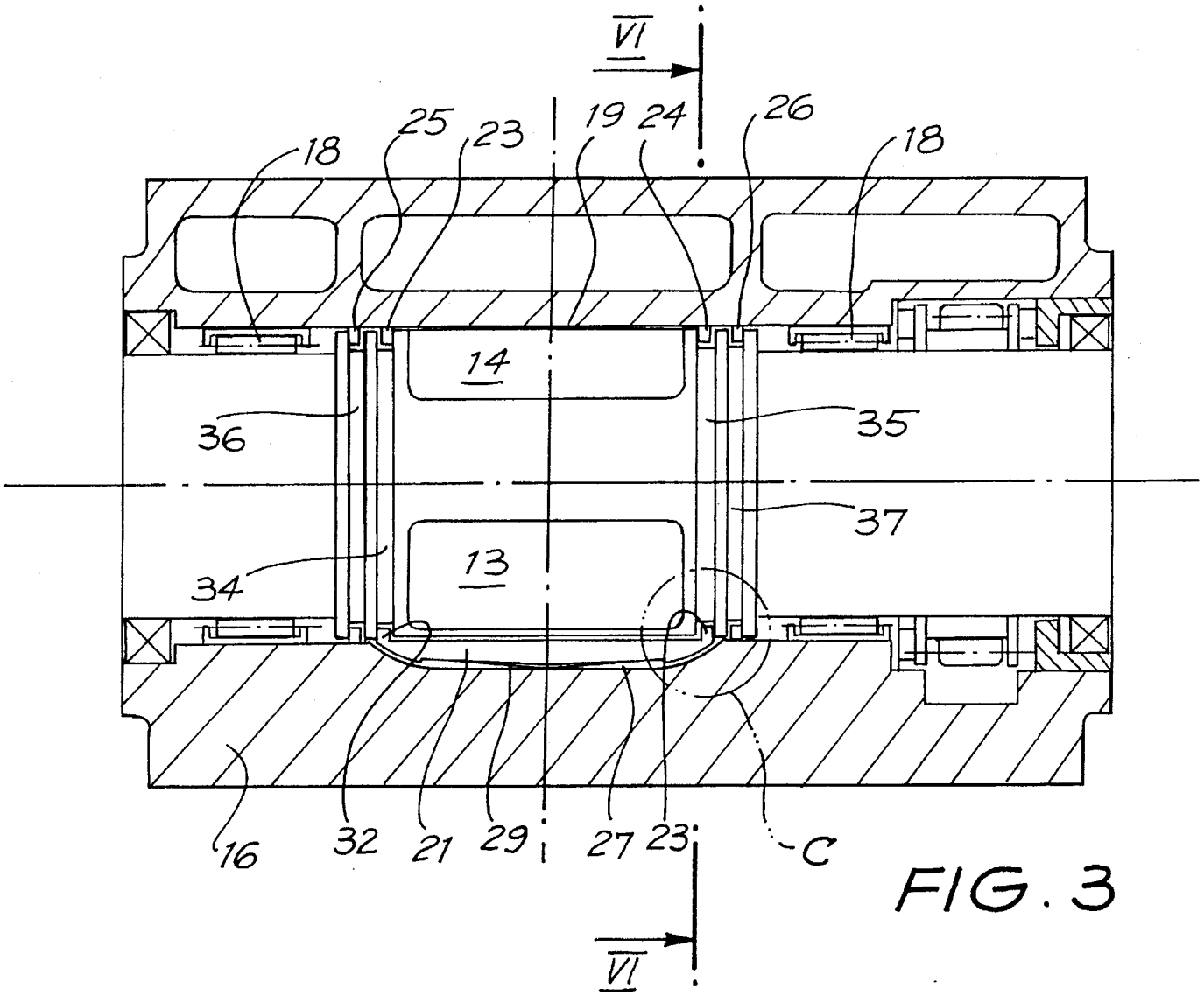
FIG. 3 is a sectional view on line B—B of FIG. 2, (valve not sectioned)

In the preferred embodiment rotary valve 10 incorporates inlet port 11 at one end and exhaust port 12 at the other end. These ports respectively connect with openings 13 and 14 (FIG. 3) in the periphery of the central cylindrical portion of valve 10. As the valve rotates these openings periodically align with similarly shaped window 15 in cylinder head 16 opening directly into combustion chamber 17 at the top of the piston bore (not shown). This alignment allows the passage of gases to and from the cylinder. During the compression and power strokes, the periphery of valve 10 covers window 15 in cylinder head 16 preventing escape of gases from combustion chamber 17.

Valve 10 is supported by two needle roller bearings 18. These bearings allow valve 10 to rotate in bore 19 of cylinder head 16 with central cylindrical portion 20 of valve 10 always maintaining a small radial clearance from the surface of bore 19.

Figure 1:
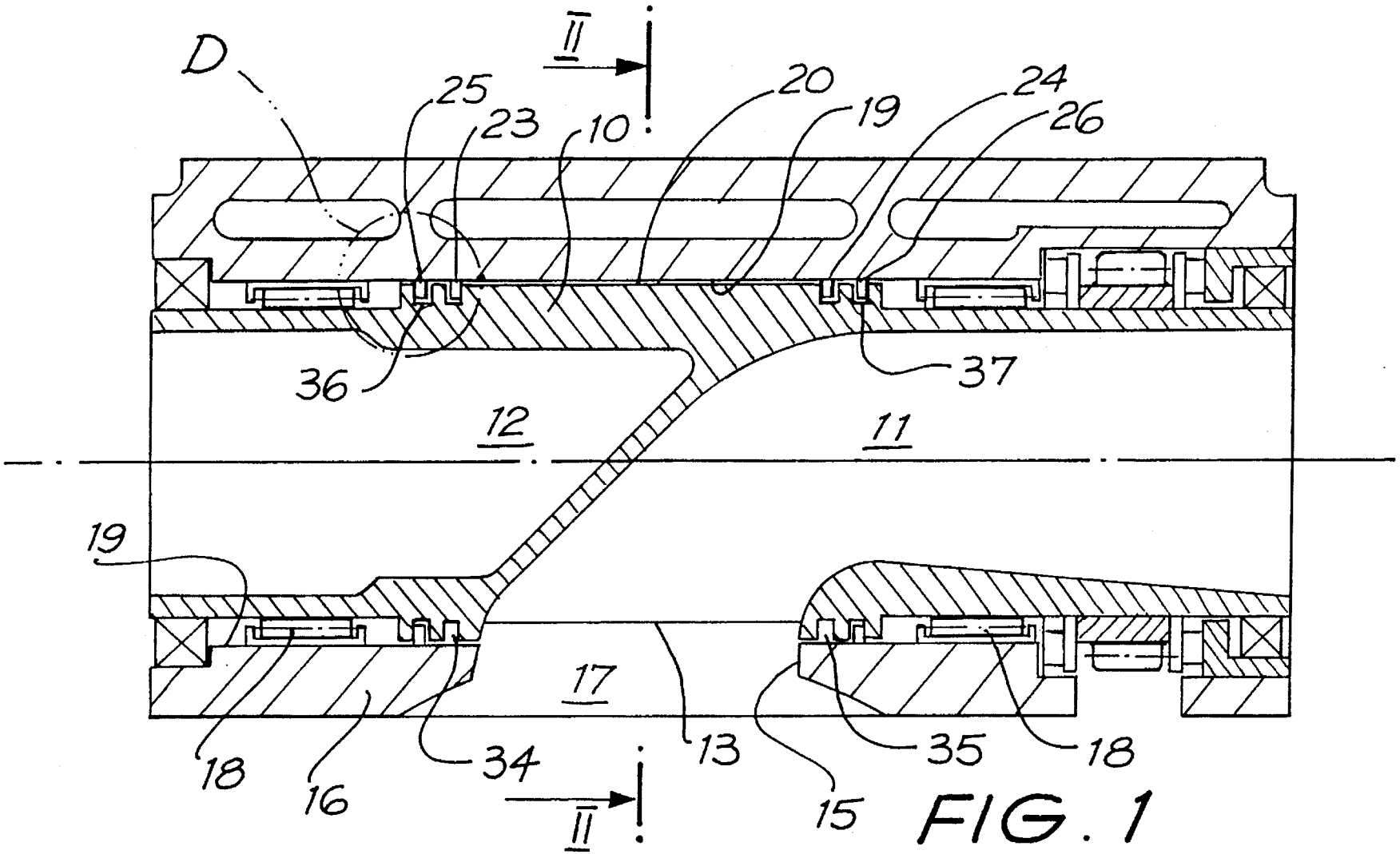
FIG. 1 is a longitudinal sectional view of a rotary valve according to the invention.
Figure 2:
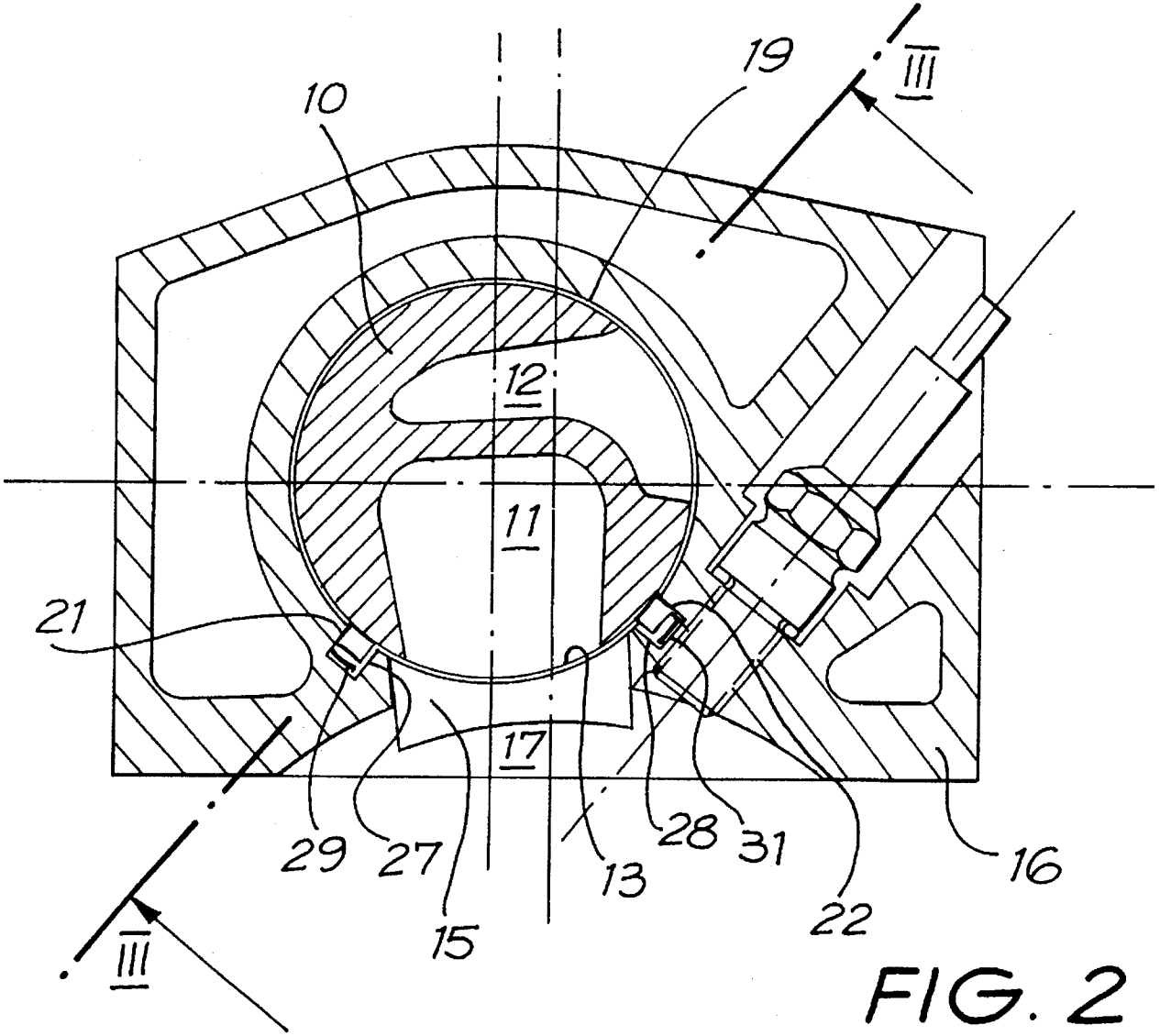
FIG. 2 is a sectional view on line A—A of FIG. 1.

High pressure gas in combustion chamber 17 is prevented from escaping by an array of floating sealing elements which seal the radial gap between bore 19 and valve 10. These sealing elements consist of two axial seals 21 and 22 (FIG. 2), two circumferential inner partial ring seals 23 and 24 and two circumferential outer ring seals 25 and 26.

The leakage of high pressure gas from combustion chamber 17 around valve 10 into the zone behind axial seals 21 and 22 and between the inner partial ring seals 23 and 24 is prevented by the circumferential sealing system comprising axial seals 21 and 22 and inner partial ring seals 23 and 24. The axial outward leakage of high pressure gas is prevented by the axial sealing system comprising outer ring seals 25 and 26.

The axial seals 21 and 22 are located either side of window 15 in cylinder head 16 and are parallel to the rotational axis of valve 10. They are housed respectively in blind ended arcuate slots 27 and 28 machined into cylinder head 16. Note it is not essential that these slots are arcuate. In this embodiment they could simply be blind ended. The only practical method of producing these blind ended slots in high-volume production is to make them arcuate. In very small quantities, where cost is not a consideration, a non-arcuate blind ended slot may be electro discharge machined (EDMed) into cylinder head 16.

Each axial seal 21 or 22 is a parallel sided strip of material whose upper sealing surface is radiused to conform to the outside diameter of the central cylindrical portion of valve 10 and whose lower surface is contoured to match the shape of blind ended arcuate slot 27 or 28. The axial seals 21 and 22 are loaded against the surface of valve 10 by means of leaf springs 29 and 31. At both ends of axial seal 21 or 22 small lugs 32 and 33 rise above the radiused upper surface of axial seals 21 or 22. These lugs engage into circumferential grooves 34 and 35 machined into the rotary valve 10. The length over the ends of these lugs 32 and 33 is such that they have a small clearance to the axially outer faces of circumferential grooves 34 and 35. These outer faces of circumferential grooves 34 and 35 provide the axial location for the axial seals 21 and 22. The width of these lugs is such as to ensure their axially inner surfaces can never contact the axially inner faces of circumferential grooves 34 and 35. Any load on the axial seal lugs is therefore always axially compressive in nature.

Figure 4:
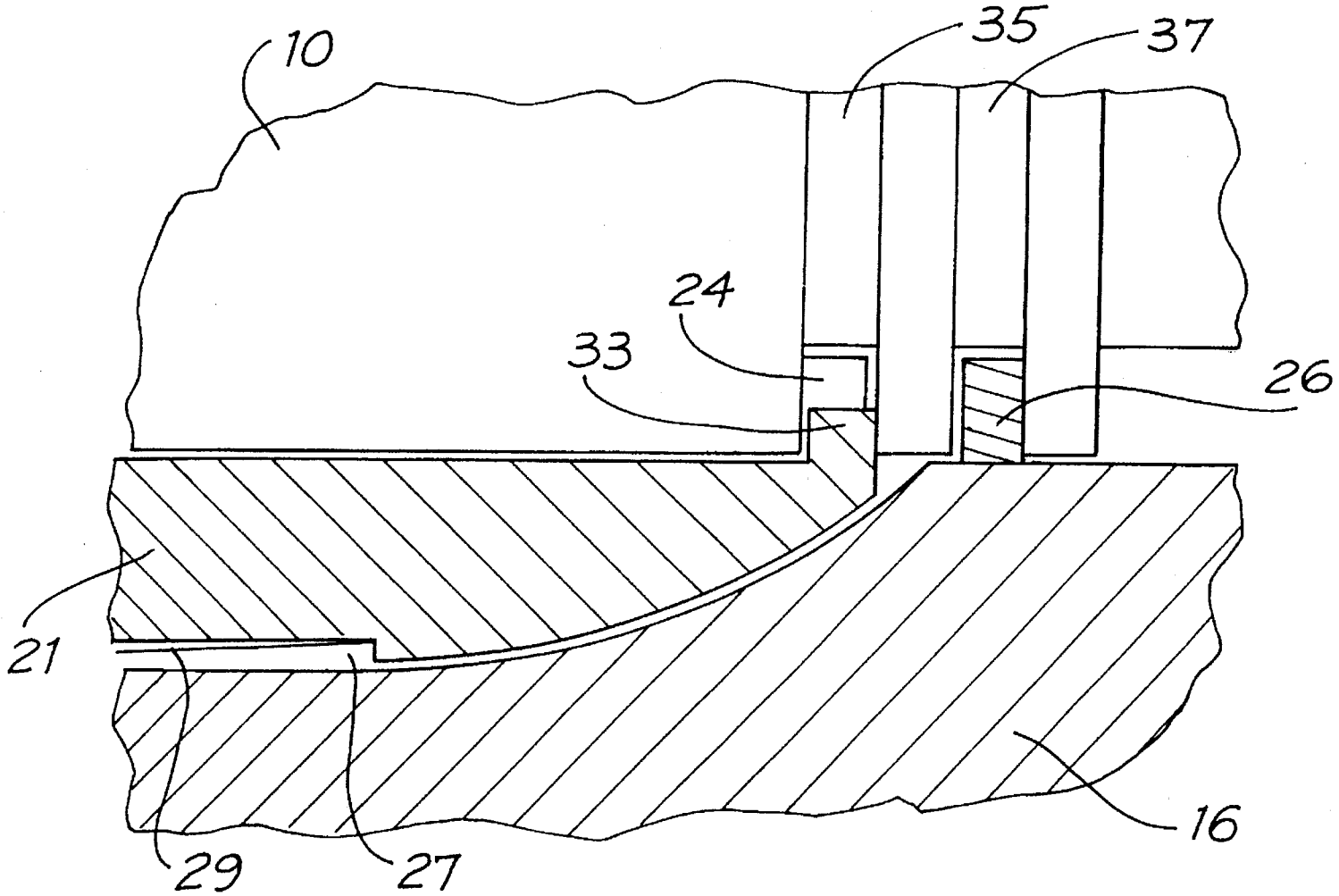
FIG. 4 is an enlarged view of portion C of FIG. 3.

The blind ended arcuate slots 27 and 28 are each constructed so that their radial depth becomes zero some small distance before the slot reaches outer ring seal 25 or 26, thus ensuring there is no path for axial leakage past the outer ring seals 25 or 26 (see FIG. 4).

Figure 6:
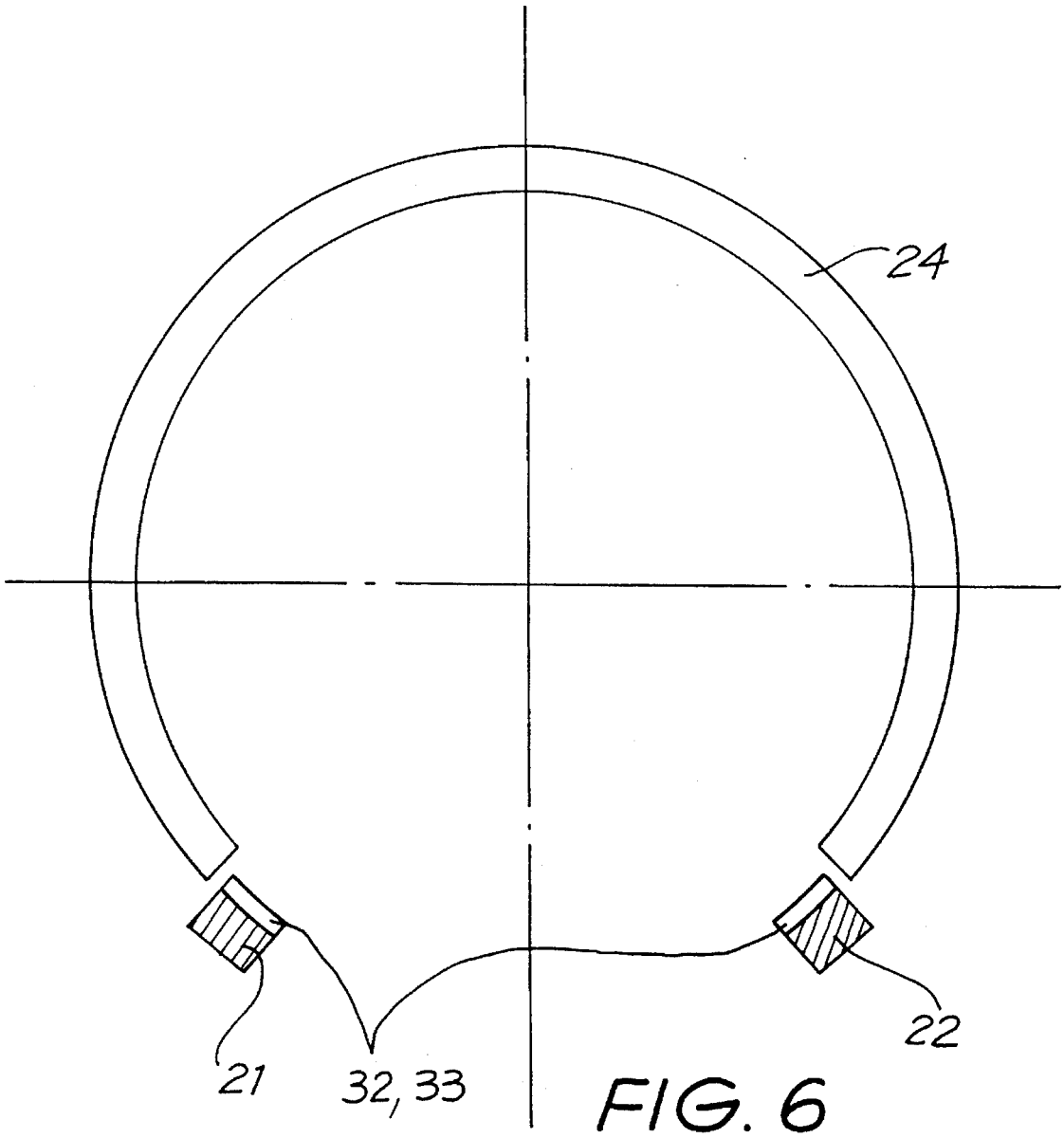
FIG. 6 is a sectional view on line E—E of FIG. 3 with details of the valve and cylinder head removed.

Each inner partial ring seal 23 or 24 is a piston type ring seal with a portion of the ring removed. Inner partial ring seals 23 and 24 are located so that they span between the circumferentially outer faces of axial seals 21 and 22 as shown in FIG. 6.

The inner partial ring seals 23 and 24 are housed in circumferential grooves 34 and 35 machined into valve 10. Each partial ring seal itself has a small axial clearance in the circumferential grooves (of the order of 0.025–0.075 mm) and its radially outer surface is preloaded against bore 19 in cylinder head 16. It is orientated and prevented from rotation by lugs 32 and 33 present on each end of axial seals 21 and 22.

The outer ring seals 25 and 26 are each a piston ring type seal housed in circumferential grooves 36 and 37 also machined into valve 10. These circumferential grooves are located respectively axially outboard of circumferential grooves 34 and 35 housing the inner partial ring seals 23 and 24 and, as stated earlier, axially outboard of blind ended arcuate slots 27 and 28. Outer ring seals 25 and 26 have, a small axial clearance in circumferential grooves 36 and 37 and their radially outer surfaces are preloaded against the bore 19 in which valve 10 is housed. They are prevented from rotation by ensuring that each ring has an appropriate cross-sectional aspect ratio.

To understand this invention first consider where the high pressure gas in the combustion chamber can escape. There are two basic zones into which this gas can escape:

a) Firstly an axial zone located axially outward of the outer ring seals 25 and 26.

b) Secondly a circumferential zone bounded by the outer faces of the axial seals 21 and 22, and the inner faces of the inner ring seals 23 and 24. Flow into this zone can be circumferentially past the axial seals 21 and 22 or axially inwardly past the inner ring seals 23 and 24.

The previous "window of floating seal" design disclosed in Bishop U.S. Pat. No. 4,852,532 attempted to seal the gas flows into these two zones with the same set of seals by containing the high pressure gas within a rectangle formed by the inner surface of the four sealing elements.

The present invention separates the sealing of flow into these two zones by providing two independent sealing systems: a circumferential sealing system to seal against flows into the circumferential zone and an axial sealing system to seal against flows into the axial zone. Instead of confining the high pressure gas to a rectangular zone it allows it to expand out of this rectangular zone into annuli located at either end of the rectangular zone.

Figure 7:
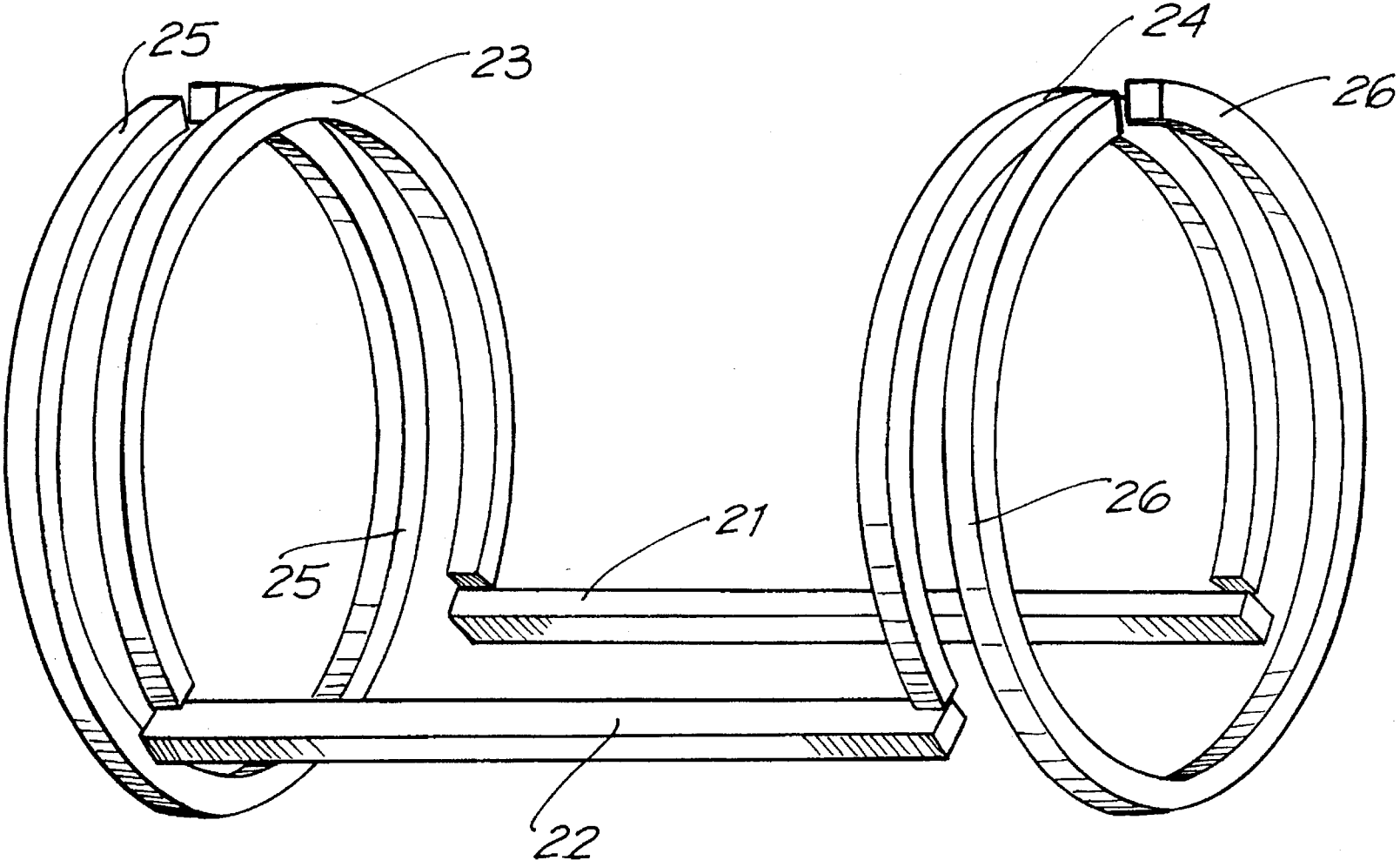
FIG. 7 is a diagrammatic view illustrating the relationships between, and geometry of the seals with details of the valve and cylinder head removed.

FIG. 7 illustrates diagrammatically the relationship between and the geometry of the axial seals 21 and 22, the inner partial ring seals 23 and 24 and the outer ring seals 25 and 26.

Figure 5:
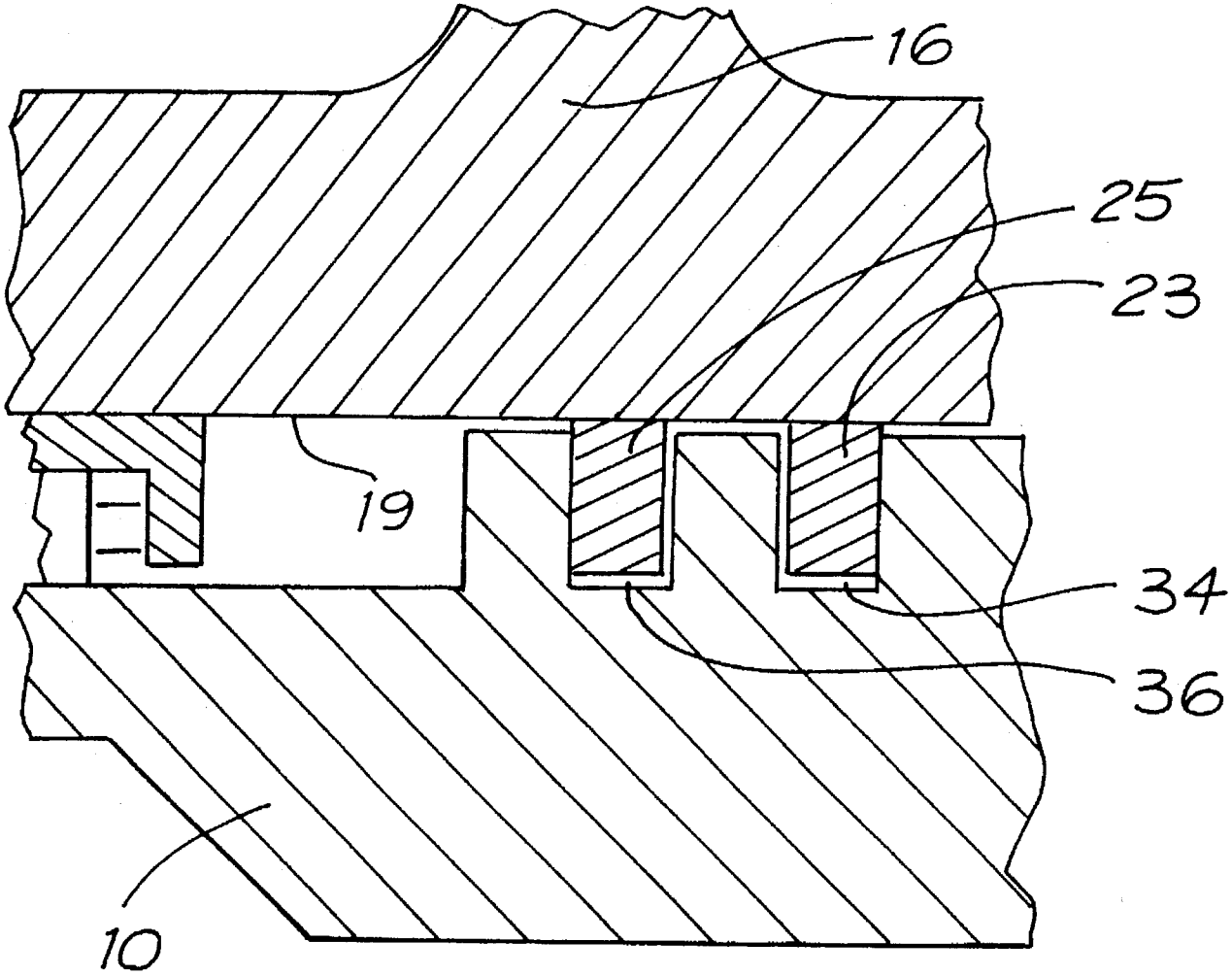
FIG. 5 is an enlarged view of portion D of FIG. 1.

Axial seals 21 and 22 define between them a first seal pressurising cavity bounded circumferentially by these seals, bounded radially by the small clearance fit between the periphery of the central cylindrical portion 20 of valve 10 and bore 19 and bounded axially by the plane of the inner faces of the inner ring seals 23 and 24. The annular volume formed between the inner partial ring seal 23, the outer ring seal 25, the grooves 34 and 36 and the surface of bore 19 (see FIG. 5) and between the inner partial ring seal 24, the outer ring seal 26, the grooves 35 and 37 and the surface of bore 19 define two second seal pressurising cavities. By reason of the fact that the inner partial ring seals 23 and 24 do not extend over the circumferential space between the axial seals 21 and 22 a passage is formed connecting the first seal pressurising cavity to the second seal pressurising cavities. The effect of this is that high pressure gas from combustion chamber 17 during compression and combustion acts to load axial seals 21 and 22 radially inwardly against the surface of valve 10 and circumferentially outwardly against the circumferentially outer faces of blind ended slots 27 and 28. Also the pairs of ring seals 23, 25 (and 24, 26) are forced apart against the faces of the circumferential grooves within which they are contained and loaded radially outwardly against bore 19 against which they are preloaded.

This invention overcomes all problems arising from the Bishop U.S. Pat. No. 4,852,532 and the Dana Corporation U.S. Pat. No. 4,019,487.

Firstly, by separating the axial and circumferential sealing functions enables the inner ring seals 23, 24 and the axial seals 21, 22 to be pushed toward one another rather than away from one another. This dramatically reduces the TELA. The resultant TELA is the product of the clearance existing between the circumferentially inner faces of the inner partial ring seals 23 and 24 and the circumferentially outermost faces of the axial seals 21 and 22, and the small radial clearance between the central cylindrical portion 20 of valve 10 and the surface of bore 19. If we assume 1. the magnitude of the clearance between the axial seals and the ring seal is the same for both the current arrangement and that arrangement in the Bishop specification and 2. the magnitude of the clearance between the axial seals and the ring seals is the same as the radial clearance between the ring seal and its groove then;

the magnitude of the TELA varies as the ratio of the small radial clearance between the central cylindrical portion 20 of valve 10 and the surface of bore 19 divided by the sum of the depth and the width of the circumferential groove. Typically the invention exhibits a TELA in the order of one thirtieth (1/30) that of the Bishop specification.

Typical total values of TELA for the gas sealing geometry in the present invention is 0.02 $mm^2$, less than the leakage area for a typical piston ring assembly.

Secondly the compression and combustion gases can act on all seals in a manner which increases the closing force on the sealing faces of the seals as the pressure to be sealed increases, consistent with normal piston ring design practice. This contrasts to the situation revealed in the Dana Corporation U.S. Pat. No. 4,019,487 where the combustion gases act on the ring seals to unload the preloaded closing force on the sealing faces.

Thirdly, according to the preferred embodiment of the present invention, the ring seals are no longer preloaded against their moving sealing surfaces—the ring seals are preloaded against the static surface of the cylinder head bore. Their loading against the sealing faces of the valve is combustion/compression pressure activated with the sealing force being directly proportional to the pressure of the gases to be sealed.

As the ring seals are not preloaded against the rotating surfaces of the valve against which they seal (as in the case of Dana Corporation U.S. Pat. No. 4,019,487 and Bishop U.S. Pat. No. 4,852,532) the sealing rings contribute no frictional losses during the induction and exhaust strokes.

Similarly as these seals are not in intimate contact with their mating surfaces during the entire cycle there is ample opportunity for lubricant to be introduced between the rotating surface and the ring seal. As each ring seal will be some very small distance from its rotating seal faces when compression commences there will be some small initial leakage past the face before the ring seats, and lubricant carried by the air can therefore be introduced between these faces. Alternatively such a mechanism could occur on the induction stroke.

Fourthly, the closing pressure between the ring seal and the rotating face against which this ring seal seals is uniform, which is clearly not the case where the rings seals are radially inwardly preloaded against the rotating valve member.

Fifthly, in the event that blind ended axial slots are used as revealed in Bishop U.S. Pat. No. 4,852,532 there is no requirement for a sleeve around the outer diameter of the valve to house the sealing elements as disclosed in Dana Corporation U.S. Pat. No. 4,019,487. The valve can thus be located much closer to the top of the cylinder bore.

Sixthly, as all the sealing elements are located by the valve, any relative movement between the valve and the cylinder head bore does not result in 1) the ring seals rubbing against a different section of the valve's surface or 2) the valve's surface rubbing against a different section of the axial seal's surface.

Finally by allowing the sealing rings to be housed in the valve it enables the valve to be located considerably closer to the top of the cylinder bore which is an extremely important factor in the design of efficient compact combustion chambers.

It is possible to produce a similar solution in terms of TELA and sealing action by locating both axial seals and ring seals in the cylinder head bore. This arrangement however does suffer from the other difficulties discussed above where the ring seals are preloaded against the rotating surface of the valve. In such an arrangement the axial seal may abut the axially inner face of each inner ring seal. Alternatively the circumferential end faces of the inner ring seal may abut the axially outer faces of the axial seals.

There are two possible approaches to sealing the axial outward flow of high pressure gas. There is the piston ring approach an example of which is described above and which functions in the same manner as the inner ring seal except that it seals the outward axial flow of gas whereas the inner ring seal seals the inward axial flow of gas.

Figure 8:
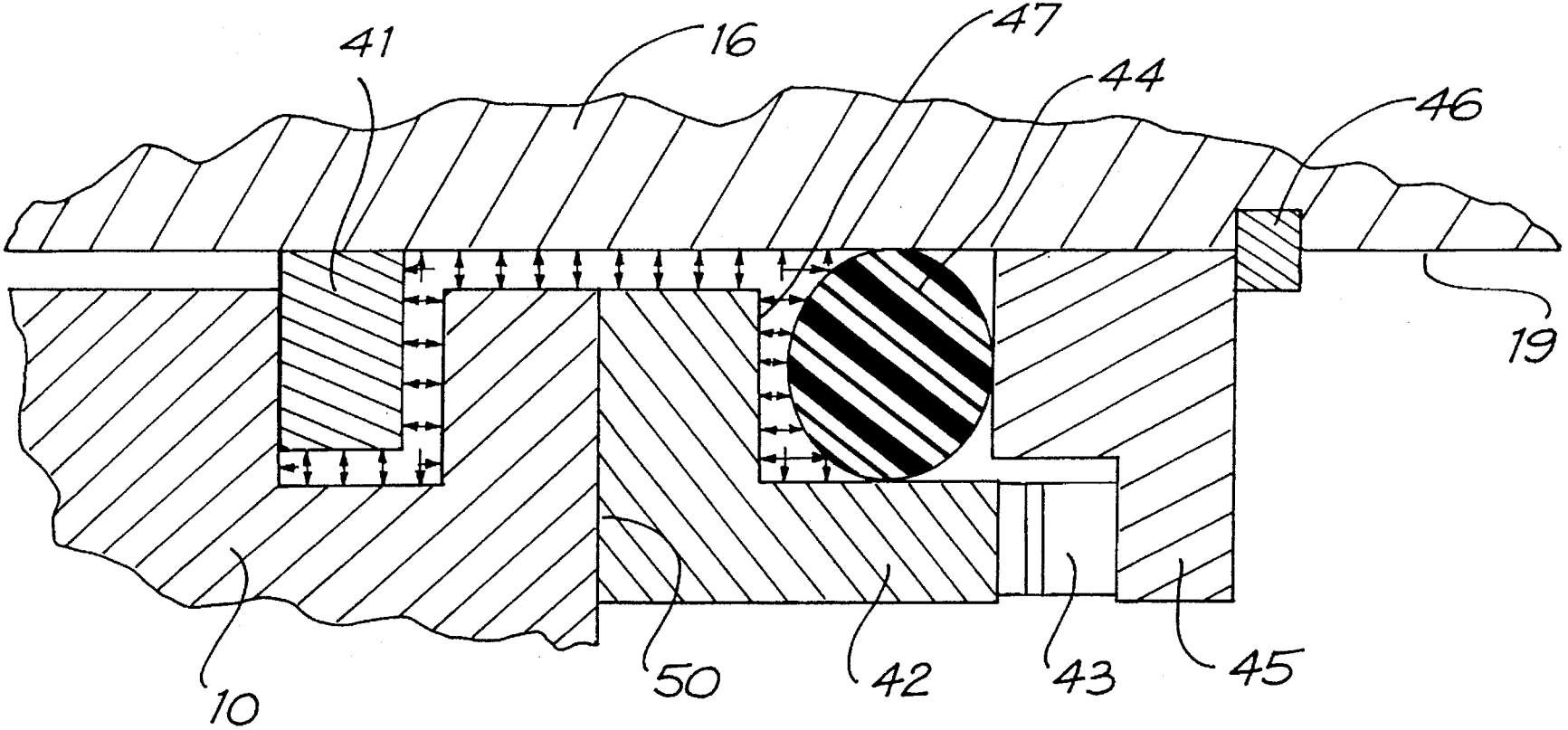
FIG. 8 illustrates diagrammatically a pressure balanced face seal arrangement.

The second approach is to use a pressure balanced face seal. The simple arrangement is illustrated in FIG. 8. An inner partial ring seal 41 is housed and operates as described above. A continuous face seal 42 is lightly axially preloaded by means of spring 43 against radial face 50 on valve 10. An "O" ring 44 prevents the axial outflow of gas past the outer diameter of face seal 42.

The location of the high pressure gases and the direction in which this pressure acts is shown in FIG. 8. "O" ring 44 is axially located by backing ring 45 and circlip 46 in bore 19. By varying the depth of the face 47 on the face seal, the closing pressure at radial face 50 can be varied—hence a pressure balanced face seal.

This arrangement has the added advantage that it not only forms a gas seal impeding the axial flow of high pressure gases but it simultaneously forms an oil seal preventing the inward movement of oil which is necessarily present around the outer envelope of the face seal.

Figure 9:
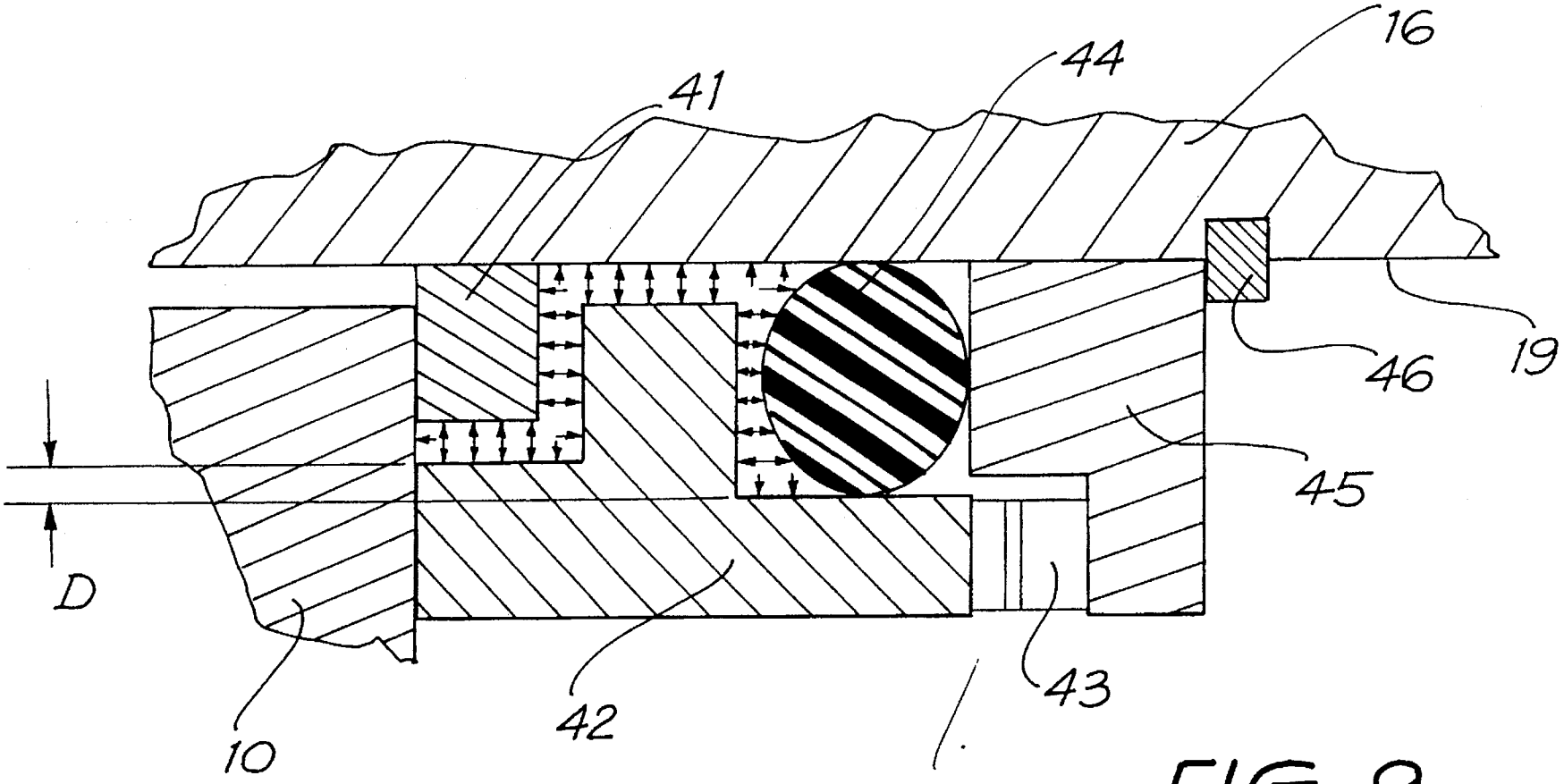
FIG. 9 illustrates an alternative arrangement to that shown in FIG. 8.

An alternative arrangement is shown in FIG. 9. Here the pressure balanced face seal and the inner partial ring seal both seal against the same radial face 50 of valve 10. The degree of pressure balance is now a function of dimension D and as a result a much greater degree of pressure balance is available.

Compared to the piston ring solution both these arrangements suffer from the disadvantage that the location of backing ring 45 is fixed in the housing. Any movement of the valve relative to the housing must therefore be accommodated.

In addition, the pressure balanced face seal is always located against radial face 50 of valve 10. This has the advantage that it is thus able to combine the gas and oil sealing functions. However as the Mount of air leakage across the sealing face during compression and combustion strokes must always be greater than the amount of oil leakage across this face during the induction stroke (due to higher pressure gradient and lower viscosity of air), any presence of oil on these faces will soon be totally removed. In the absence of materials that will operate without lubrication, pick up will soon occur. On the other hand the quantity of lubricant required is much reduced as a result of the pressure balance that can be achieved with the face seal design.

In terms of friction losses to the seal assembly, the friction loss due to the constant spring load pushing face seal 42 into contact with valve 10 is traded off against the reduced maximum sealing pressure due to the pressure balance.

The other important feature to be considered are the "crevice" volumes. These are the tiny volumes that exist adjacent to the sealing elements and are essential to the correct functioning of the sealing elements. They are volumes contained between surfaces that are so close to one another that it is impossible for the flame to burn in these regions. As a result the air/fuel mixture residing in these spaces remains unburned and power output and fuel economy is adversely affected. In addition the unburned fuel/air mixture is partially exhausted during the exhaust stroke and contributes to hydrocarbon emissions.

In general terms the magnitude of this problem is a function of the crevice volume as a proportion of combustion chamber volume at T.D.C. (top dead centre). Poor design and attention to detail could see this ratio approach 5%.

Similar problems arise in the event that leakage takes place past the seals. The air/fuel leaking past the seals represents lost power and fuel economy but reduced hydrocarbon emissions as this air fuel mixture is partially recirculated into the induction system.

In considering the relative merits of these gas sealing arrangements their crevice volumes and leakage rates are essential considerations.

The pressure balanced face seal has nearly zero leakage but its crevice volumes may get rather large if considerable relative movement between the valve and the cylinder head bore has to be accommodated. The earlier referred to outer ring seal solution has somewhat larger leakage but potentially smaller crevice volumes.

The relative merits of each system require investigation for any particular application. It is essential therefore to reduce the crevice volumes to an absolute minimum.

Crevice volumes exist on all conventional internal combustion engines. The most significant contribution is the area around the piston rings. It should be noted that the crevice volumes around the rotary valve are less significant than those around the piston ring. This results from the fact that the spark plug is located adjacent to the window in the cylinder head and gases present in crevice volumes adjacent to this zone will burn first. The piston ring crevices are located at the furthermost point from the spark plug. The gases adjacent to these crevices are therefore last to burn. As the cylinder pressure increases as combustion takes place an ever increasing mass of unburned air/fuel mixture will be pushed into the crevice volumes around the piston rings. As the gas around the cylinder head window has already burnt this increase in pressure will push in additional burnt mixture only.

Assuming the radial clearance between valve 10 and cylinder head bore 19 is small, the main contribution to crevice volumes is volumes under the axial seals and around the ring seals. In single piece cylinder heads the volume under the axial seals is relatively large as clearance under these seals must be provided to allow depression of the axial seals so the lugs at each end of each axial seal will not interfere with the valve and ring seals during assembly.

Crevice volumes around the sealing rings result from axial clearance of ring to circumferential groove (small), radial clearance of the bottom of the circumferential ring groove to the inner diameter of the sealing ring (potentially large if tolerances are not tightly specified), separation distance between the inner and outer ring seals and the presence of only a partial sealing ring in the inner ring circumferential grooves (large volume).

Figure 10:
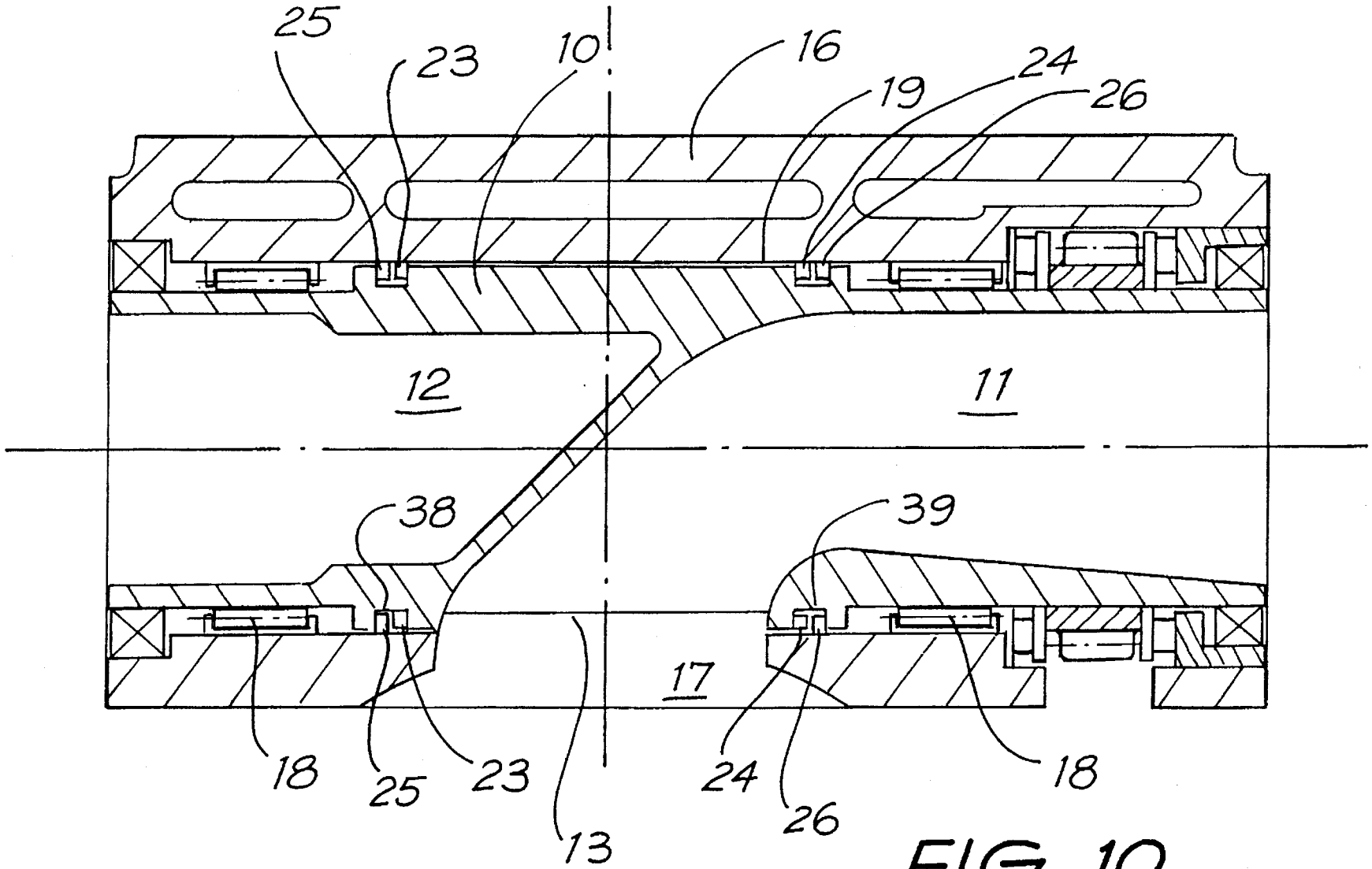
FIG. 10 is a view similar to FIG. 1 having a modified form of rotary valve in which inner partial ring seals and outer ring seals are contained within the same circumferential groove in the rotary valve.

These problems are addressed in the embodiment of the invention shown in FIG. 10. Here both the inner ring seals 23 and 24 and the outer ring seals 25 and 26 are housed in the same circumferentially extending groove 39 with only a small axial clearance. As previously, the blind ended arcuate slots 27 and 28 must achieve zero depth before it reaches the outer ring seal.

Alternatively it is permissible for the blind ended arcuate slots 27 and 28 to reach zero depth after the axially inner face of the outer ring seals 25 and 26 provided it reaches zero depth a reasonable distance before the axially outer face of the outer ring seals 25 and 26.

Figure 11:
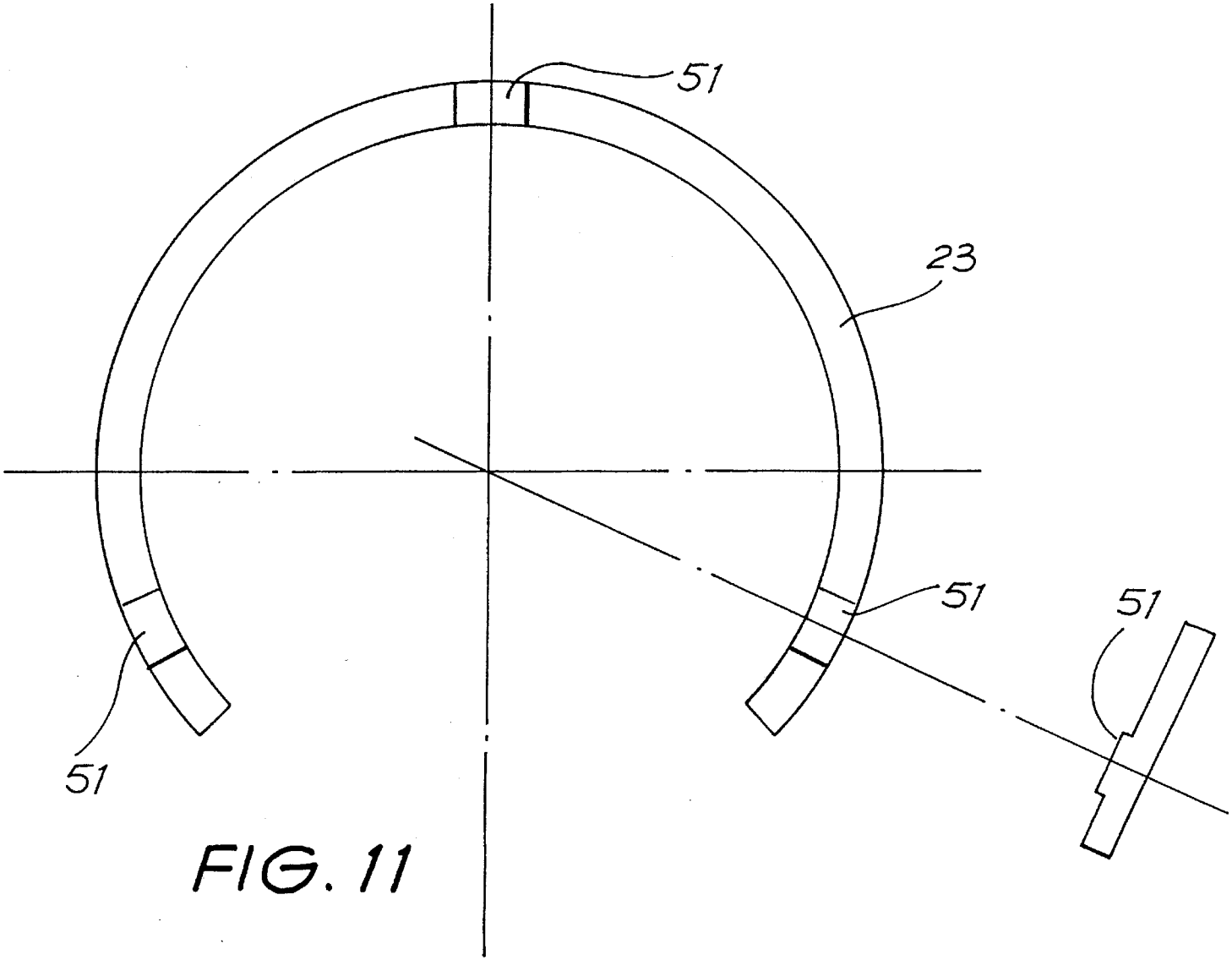
FIG. 11 shows views of the inner partial ring seal in FIG. 10.

It is essential that a small gap is always maintained between the inner ring seals 23 or 24 and outer ring seals 25 or 26 to ensure the high pressure gas will migrate between these ring seals and thus load the ring seals against their sealing faces within their respective circumferential groove. To achieve this, localised raised area 51 can be machined onto either the axially innermost face of the outer ring seals 25 and 26 or the axially outermost face of the inner ring seals 23 and 24 as shown in FIG. 11.

Figure 12:
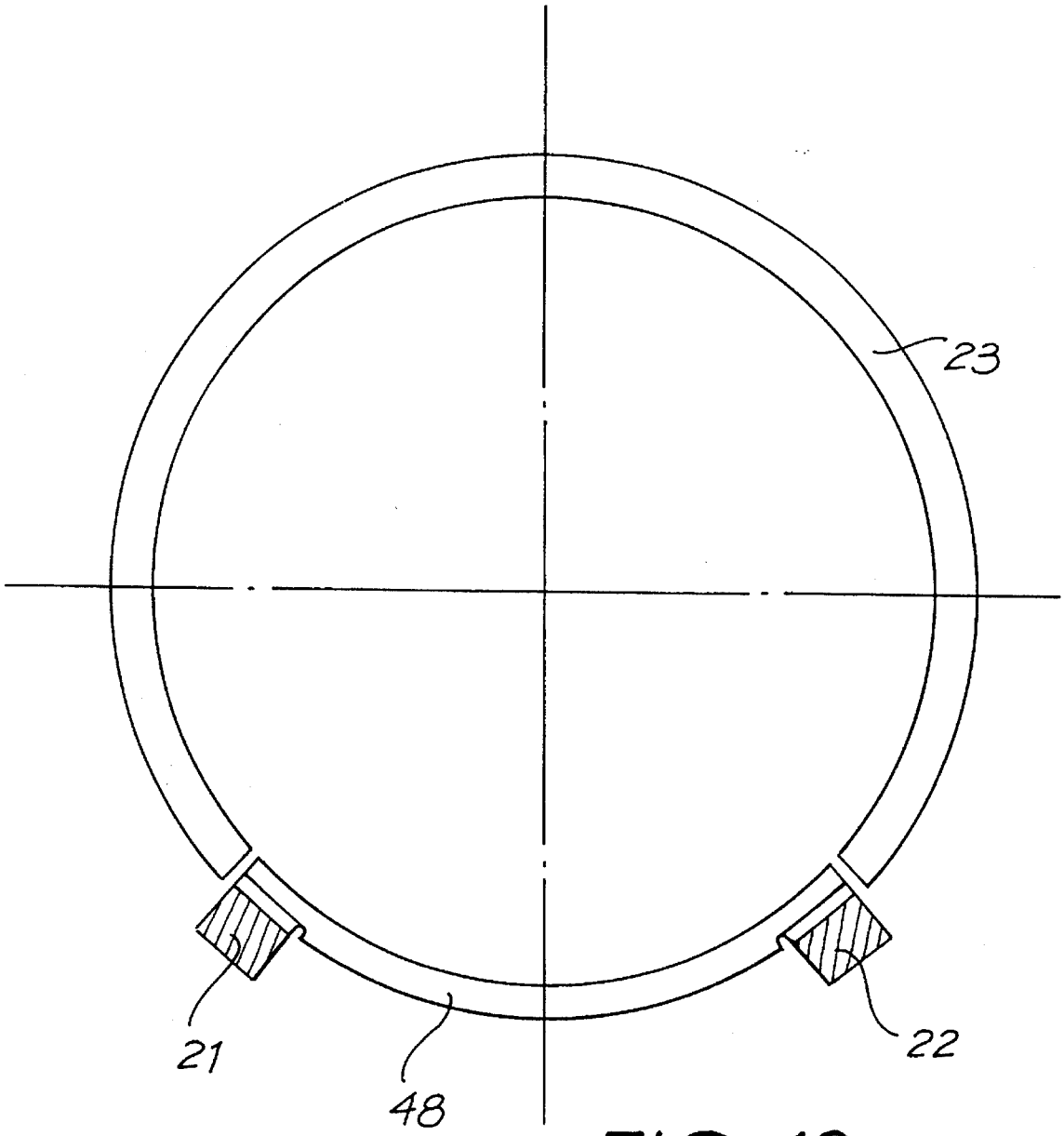
FIG. 12 shows an alternative arrangement for the inner ring seal.
Figure 13:
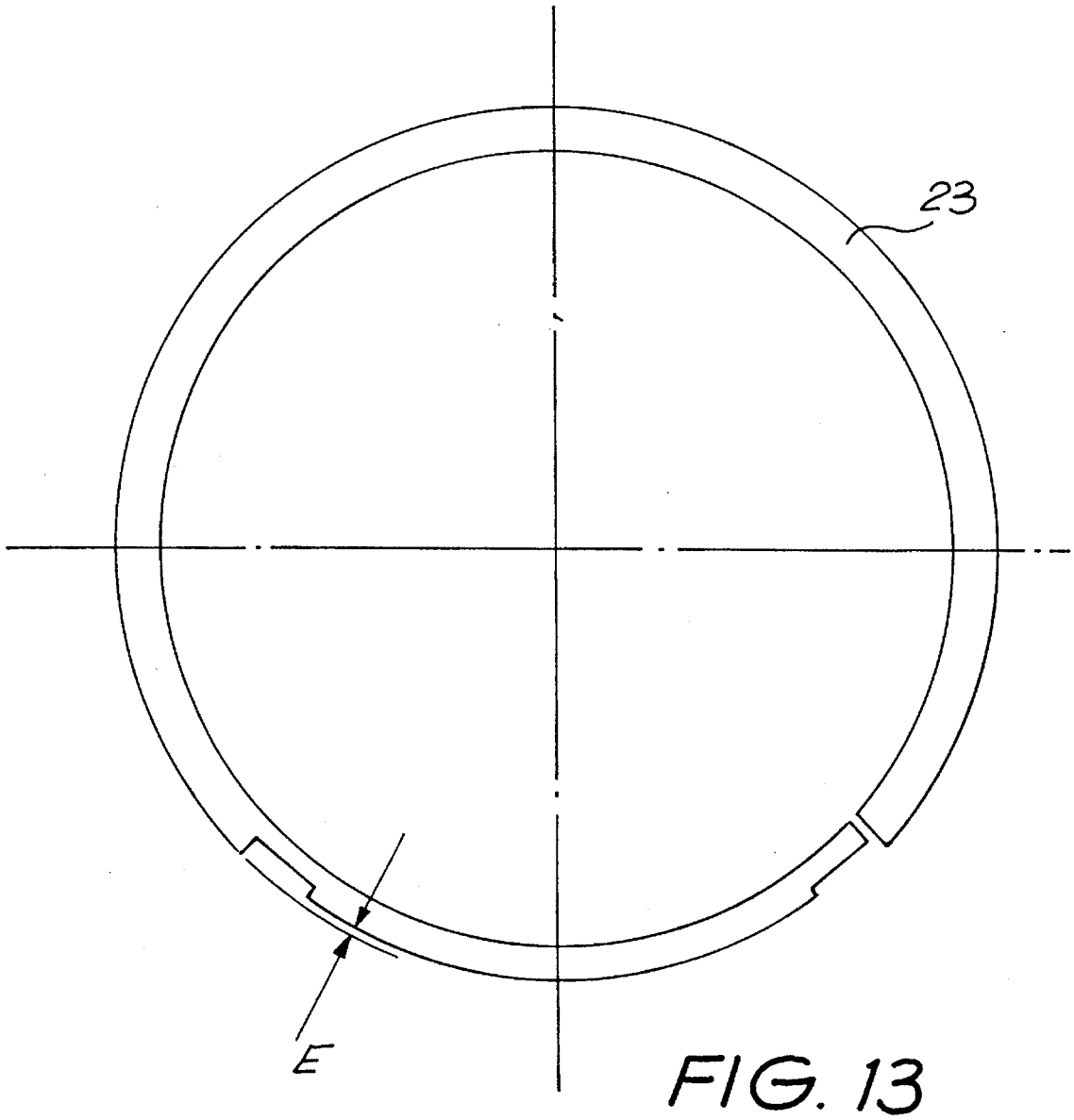
FIG. 13 is a similar view showing a further alternative construction.

The volume in the inner ring seal circumferential groove previously left unoccupied as a result of the inner ring seal being a partial ring is now filled by the presence of an additional segment of ring 48 in FIG. 12. This ring segment has its ends radially relieved to enable it to sit on top of the lugs at the ends of the axial seals 21 and 22 and its ends abut the ends of the inner partial ring seal 23. An alternative arrangement is shown in FIG. 13 where the inner ring seal 23 is now a complete ring with cutouts in its periphery to allow clearance for the lugs on the end of the axial seals 21 and 22.

In addition the portion of ring which occupies the space between axial seals 21 and 22 is relieved on its outer diameter by a radial depth E equal to or greater than the radial clearance between the valve 10 and the cylinder head bore 19. This ensures that gas can reach the cavity between the inner and outer ring seals and therefore allows communication between the aforementioned first seal pressurising cavity and the second seal pressurising cavities.

In this arrangement the ends of the axial seals no longer abut the axially outermost radial faces of the inner ring circumferential grooves. Rather they abut the axially inner faces of the outer ring seal. This has two advantages: firstly they abut a stationary face rather than a rotating face and secondly the surface against which the axial seal abuts now extends to the cylinder head bore 19.

This means that, in the absence of lugs on the ends of the axial seals, the ends of the axial seals will still overlap the outer ring seals (ie. the abutting face) by an amount equal to the radial clearance of the valve to the cylinder head bore. Axial location of the axial seals is thus possible without the requirement of lugs 32 and 33.

In the event the presence of lugs 32 and 33 create undesirable crevice volume under the axial seals two courses of action are available:

(a) remove the lugs from the trailing axial seal only. As the rotating valve always pushes the inner ring seal towards the leading axial seal a lug on this axial seal is all that is required.

Figure 14:
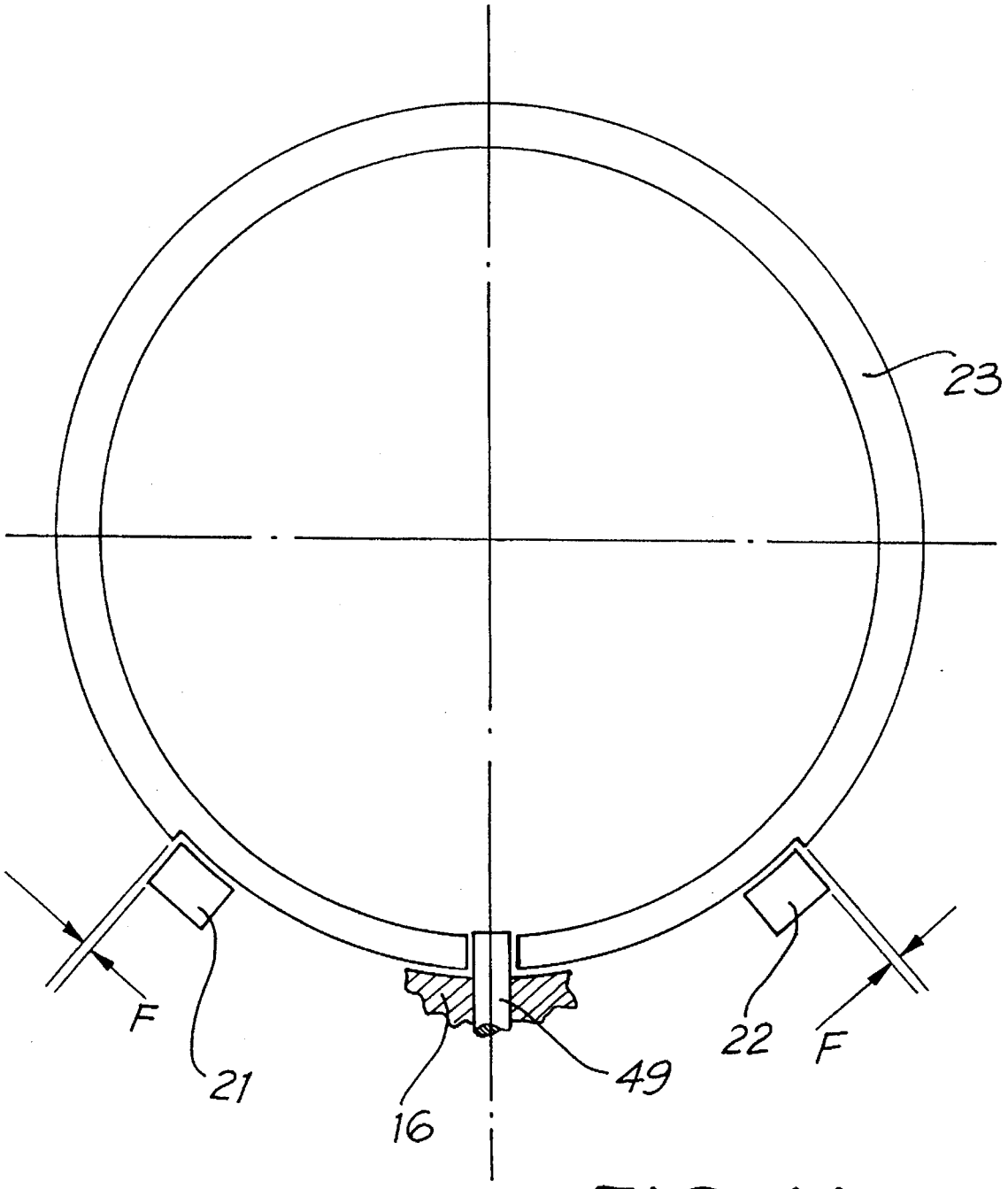
FIG. 14 is a similar view illustrating the use of a pin to locate an inner ring seal against circumferential movement.

(b) remove the lugs from both axial seals and locate the inner ring seal by means of a pin secured in the cylinder head bore. This solution has the disadvantage that one member (ie. the pin) of the sealing system is now fixed in the cylinder head bore. Without the pin all sealing elements are located by means of the valve itself. In the event the axial location of the valve in the bore alters, all the sealing elements are constrained to move with the valve. A pin locating the inner ring seal would thus require accurate axial location relative to the circumferential grooves and must have sufficient side clearance in these circumferential grooves to cater for any axial movement of the valve. Such a pin is illustrated at 49 in FIG. 14. In addition, as the orientation of the inner ring seal relative to the axial seals is now determined by the pin and not the axial seals themselves, the clearance F must be increased to allow for manufacturing tolerances and a clearance F must be provided at the inner ring seal's intersection with both axial seals—unlike the present case where a clearance gap F exists at the trailing axial seal only. The resulting increased leakage must be balanced against the reduction in crevice volume achieved by removing the lug.

The location of both ring seals in the same circumferential groove offers one additional advantage in that it provides a method of physically restraining the outer ring seal against rotation. Where the outer ring seal is located in a separate groove physical restraint against rotation is only available if a pin located in the cylinder head bore is used. Such a pin has the disadvantages referred to above. The best solution is generally to arrange the cross-sectional aspect ratio of the outer ring seal to prevent rotation. In the event of marginal lubrication between the outer ring seal and the valve, this may be insufficient to prevent spinning of the outer ring seal in the bore.

With both inner and outer ring seals located in the same circumferential groove the outer ring seal can be keyed to the inner ring seal by means of a tongue and groove arrangement—in which a laterally projecting tongue on a face of one ring seal extends into a similarly shaped groove on the adjacent face of the other ring seal. As the inner ring seal is prevented from rotation by means of engagement with the axial seals, the outer ring seal is now restrained from rotation.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

I claim:

1. A rotary valve assembly for an internal combustion engine comprising a hollow cylindrical valve, said valve having one or more ports terminating as openings in its periphery, a cylinder head having a bore in which said valve rotates in a predetermined small clearance fit, a window in said cylinder head bore communicating with a combustion chamber, said openings successively aligning with said window by virtue of said rotation, bearing means at least one axially on each side of the window for journalling said valve in said cylinder head bore, said bearing means serving to maintain said predetermined small clearance fit, axial sealing elements housed within said cylinder head bore extending inwardly of said bore an amount equal to said predetermined clearance fit and being preloaded against the periphery of the valve, said axial sealing elements being housed within axially extending grooves formed in said cylinder head bore, said grooves being positioned at least one on each side circumferentially of said window, two inner circumferential sealing elements positioned along the axis of said valve and housed in circumferentially extending grooves formed either in said periphery of said valve or in said cylinder head bore and radially preloaded against the surface of the other, each said inner circumferential sealing element being positioned at either axial extremity of said axial sealing elements and immediately adjacent thereto, a first seal pressurizing cavity existing by virtue of said predetermined small clearance fit and formed circumferentially between said axial sealing elements on either side of said window, and bounded axially by the planes of the inner faces of said inner circumferential sealing elements, whereby high pressure combustion gas pressurizes said first seal pressurizing cavity during combustion by virtue of said communication between said window and said combustion chamber thereby loading said axial sealing elements radially inwardly against said periphery of said valve in a direction so as to augment said preload, and circumferentially outwardly against the sides of said axially extending grooves, characterised in that, at least two outer circumferential sealing elements are also positioned along the axis of said valve, at least one axially outwardly of each said inner circumferential sealing element, thereby defining two second seal pressurizing cavities, each lying between adjacent inner and outer circumferential sealing elements, axially on either side of said window, and passage means permitting said high pressure combustion gas to pass from said first seal pressurizing cavity to said two second seal pressurizing cavities, whereby, during combustion, said outer circumferential sealing elements are caused to seal said second seal pressurizing cavities to prevent axially outward movement of gas and said inner circumferential sealing elements are caused to be loaded axially inwardly to seal against the axially innermost sides of said circumferentially extending grooves, and loaded radially to seal against the surface against which they are preloaded.

2. A rotary valve assembly as claimed in claim 1 wherein said bearing means are rolling element bearings.

3. A rotary valve as claimed in claim 1 wherein said two inner circumferential sealing elements are, partial ring seals of the piston ring type and are housed in circumferentially extending grooves formed in said periphery of said valve, said partial ring seals extending circumferentially by more than 180° between the circumferentially outer faces of said axial sealing elements remote from said window, thereby providing said passage means.

4. A rotary valve assembly as claimed in claim 1 wherein said two inner circumferential sealing elements are of the piston ring type and are housed in circumferentially extending grooves formed in said periphery of said valve and radially preloaded against the surface of said cylinder head bore, the periphery of said two inner circumferential sealing elements adjacent said window being at least partially radially relieved to provide said passage means.

5. A rotary valve assembly as claimed in claim 1 wherein each axial sealing element is a parallel sided strip of material, its radially innermost sealing surface being concavely radiused to conform to the periphery of the valve and at least one of the axial sealing elements provided at each end with a radially inwardly extending lug arranged to engage in said circumferentially extending grooves in said valve, the periphery of said two inner circumferential sealing elements adjacent said lugs being relieved locally to enable said lugs to engage in said circumferentially extending grooves, the lugs acting to prevent rotation of said two inner circumferential sealing elements.

6. A rotary valve assembly as claimed in claim 1 wherein at least one outer circumferential sealing element is of the piston ring type and is housed in an outer circumferentially extending groove formed in the periphery of said valve axially outboard of said circumferentially extending groove accommodating said inner circumferential sealing element.

7. A rotary valve assembly as claimed in claim 1 wherein at least one outer circumferential sealing element is of the piston ring type and is housed in the same circumferentially extending groove as said adjacent inner circumferential sealing element.

8. A rotary valve assembly as claimed in claim 7 wherein at least one of the circumferential sealing elements in each said circumferentially extending groove has at least one localised raised area on one of its radially extending faces, said radially extending face being immediately adjacent a radially extending face on the other circumferential sealing element, said raised area acting to ensure high pressure gas can always enter between said radially extending faces of said circumferential sealing elements.

9. A rotary valve assembly as claimed in claim 7 wherein at least one of the outer circumferential sealing elements is keyed to an adjacent inner circumferential sealing element by means of a tongue and groove arrangement in which a laterally projecting tongue on a radially extending face of one circumferential sealing element extends into a complementarily shaped groove on the adjacent radially extending face of the other circumferential sealing element whereby the outer circumferential sealing element is prevented from rotation.

10. A rotary valve assembly as claimed in claim 1 wherein circumferential rotation of each inner circumferential sealing element is prevented by a radially extending pin secured in the cylinder head bore.

11. A rotary valve assembly as claimed in claim 1 wherein each outer circumferential sealing element incorporates a pressure balanced face seal.

* * * * *

UNITED STATES PATENT AND TRADEMARK OFFICE

CERTIFICATE OF CORRECTION

PATENT NO. : 5,526,780

DATED : June 18, 1996

INVENTOR(S) : Wallis

It is certified that error appears in the above-indentified patent and that said Letters Patent is hereby corrected as shown below:

Title page,

Item [22] insert PCT filed: November 3, 1993

Item [86] insert PCT No: PCT/AU93/00568

§371 Date: May 3, 1995

§102(e) Date: May 3, 1995

Item [87] insert PCT Pub. No. WO94/11618

PCT Pub. Date: May 26, 1994

Signed and Sealed this

Nineteenth Day of November, 1996

*Attest:*

Bruce Lehman

BRUCE LEHMAN

*Attesting Officer*

*Commissioner of Patents and Trademarks*